US009228765B2

(12) United States Patent
Oya

(10) Patent No.: US 9,228,765 B2
(45) Date of Patent: Jan. 5, 2016

(54) REFRIGERATION CYCLE DEVICE

(71) Applicant: Ryo Oya, Tokyo (JP)

(72) Inventor: Ryo Oya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 331 days.

(21) Appl. No.: 13/798,683

(22) Filed: Mar. 13, 2013

(65) Prior Publication Data

US 2013/0269380 A1 Oct. 17, 2013

(30) Foreign Application Priority Data

Apr. 16, 2012 (JP) ..... 2012-092595

(51) Int. Cl.

| | |
|---|---|
| ***F25B 41/04*** | (2006.01) |
| ***F25B 13/00*** | (2006.01) |
| ***F25B 49/02*** | (2006.01) |
| *F24D 17/02* | (2006.01) |

(52) U.S. Cl.

CPC ..... *F25B 41/043* (2013.01); *F25B 13/00* (2013.01); *F25B 49/02* (2013.01); *F24D 17/02* (2013.01); *F24D 2220/08* (2013.01); *F25B 2313/009* (2013.01); *F25B 2313/021* (2013.01); *F25B 2313/02741* (2013.01); *F25B 2313/0314* (2013.01); *F25B 2313/0315* (2013.01); *F25B 2500/31* (2013.01); *F25B 2600/0261* (2013.01); *F25B 2600/2519* (2013.01); *F25B 2700/2106* (2013.01); *F25B 2700/2115* (2013.01); *F25B 2700/21152* (2013.01); *F25B 2700/21156* (2013.01)

(58) Field of Classification Search

CPC .. F25B 41/043; F25B 41/046; F25B 2500/28; F25B 2600/2501; F25B 2700/2115

USPC ..... 62/196.1, 199, 200, 332

See application file for complete search history.

(56) References Cited

U.S. PATENT DOCUMENTS

| | | | |
|---|---|---|---|
| 6,668,572 | B1 | 12/2003 | Seo et al. |
| 2012/0023984 | A1 | 2/2012 | Sakai et al. |

FOREIGN PATENT DOCUMENTS

| | | | |
|---|---|---|---|
| CN | 201852356 | U | 6/2011 |
| CN | 102348939 | A | 2/2012 |

(Continued)

OTHER PUBLICATIONS

CN Office Action issued Dec. 3, 2015 in the corresponding CN Patent Application No. 201310128319.8 (and English Translation).

(Continued)

*Primary Examiner* — Marc Norman

(74) *Attorney, Agent, or Firm* — Posz Law Group, PLC

(57) ABSTRACT

A refrigeration cycle device includes a first refrigerant passage in which a compressor, a first solenoid valve, a four-way valve, an outdoor heat exchanger, a pressure reducing device, an indoor heat exchanger, and an accumulator are sequentially connected through pipes; a second refrigerant passage in which a second solenoid valve and a water refrigerant heat exchanger are sequentially connected to a pipe that connects a portion of a pipe between the compressor and the first solenoid valve to the pressure reducing device; heating means for heating a shell of the compressor; and a controller that performs control so as to close the first solenoid valve and the second solenoid valve in association with an operation of the compressor being stopped and so as to open the first solenoid valve when the heating means heats the compressor.

10 Claims, 3 Drawing Sheets

(56) References Cited

FOREIGN PATENT DOCUMENTS

| | | | |
|---|---|---|---|
| JP | 02-178572 | A | 7/1990 |
| JP | 04-187950 | A | 7/1992 |
| JP | 11-108473 | A | 4/1999 |
| JP | 2007-078242 | A | 3/2007 |
| JP | 2010-210208 | A | 9/2010 |
| WO | 2006/128262 | A2 | 12/2006 |
| WO | 2011/125111 | A1 | 10/2011 |

OTHER PUBLICATIONS

European Search Report dated Aug. 6, 2013 in the corresponding European Patent Application No. 13159830.2-1602 (English Translation).

Office Action mailed on Mar. 17, 2015 for the corresponding JP application No. 2012-092595 (and English translation).

Office Action mailed Sep. 29, 2015 in the corresponding JP application No. 2012-092595 (with English translation).

REFRIGERATION CYCLE DEVICE

TECHNICAL FIELD

The present invention relates to a multifunctional air-conditioning and water-heating heat pump system that includes a compressor and that can simultaneously perform an air-conditioning operation (an air-cooling operation and an air-heating operation) and a water-heating operation.

BACKGROUND ART

Refrigerant may accumulate in an outdoor unit of existing air-conditioning apparatuses under conditions in which the temperature of outdoor air is low and there is a difference between the temperature of outdoor air and the temperature of the inside of a compressor. To prevent accumulation of refrigerant even under such conditions, some existing air-conditioning apparatuses include a heater that is disposed along the outer periphery of a compressor and that heats refrigerant in the compressor, a compressor-side backflow prevention mechanism that blocks flow of refrigerant toward the compressor, and an accumulator-side flow blocking mechanism that blocks flow of refrigerant toward the accumulator. The air-conditioning apparatuses are provided with a structure that is controlled by a power source so as to be entirely closed when the power source is turned off (see, for example, Patent Literature 1).

Some other air-conditioning apparatuses include a refrigeration cycle that branches off from a portion of a refrigerant pipe between a compressor and an outdoor solenoid valve and that sequentially connects an indoor solenoid valve, an indoor condenser, and a check valve through refrigerant pipes so as to be joined to a cooler. The air-conditioning apparatuses control solenoid valves so as to control the direction of flow of refrigerant discharged from the compressor (see, for example, Patent Literature 2).

CITATION LIST

Patent Literature

[Patent Literature 1] Japanese Unexamined Patent Application Publication No. 11-108473 (pp. 3-5, FIG. 1)

[Patent Literature 2] Japanese Unexamined Patent Application Publication No. 2007-78242 (pp. 4-8, FIGS. 1 and 2)

SUMMARY OF INVENTION

Technical Problem

The existing air-conditioning apparatuses additionally include the backflow prevention mechanism and the flow blocking mechanism only for the purpose of blocking flow of refrigerant toward the compressor that is generated while the compressor is stopped.

Moreover, energization control of a heater for heating a compressor while the compressor is stopped in accordance with the temperature of outdoor air and the temperature of the compressor has problems in that, for example, a sufficient amount of heat for preventing accumulation of refrigerant in the compressor might not be supplied and power loss due to overheating may occur.

In hot-water heaters, to prevent water in a water heat exchanger from freezing, a system controller causes water to be circulated even when a defrosting operation for defrosting an outdoor heat pump water-heating unit is being performed.

However, even when water is circulated, stagnation (a state in which water does flow and stay stagnant) occurs in a passage in the water heat exchanger. Moreover, during the defrosting operation, the temperature of water that flows into the water heat exchanger becomes lower than or equal to 10° C. at the inlet of the water heat exchanger and accordingly the temperature of water at the outlet of the water heat exchanger may become lower than or equal to 0° C. As a result, freezing of water may start from a position at which water is stagnant and water in the water heat exchanger may become frozen. No patent literatures have been disclosed to solve this problem.

The present invention has been achieved to solve the problem described above. A first object of the present invention is to prevent retention of refrigerant while a compressor is stopped in an air-heating operation mode and in a water-heating operation mode and prevent seizure of a drive shaft due to insufficiency in the amount of refrigerating machine oil in the compressor.

A second object of the present invention is to suppress power consumption of a compressor heating operation, which is performed to prevent retention of refrigerant in the compressor, to a low level and increase the energy saving efficiency.

Solution to Problem

A refrigeration cycle device according to the present invention includes a first refrigerant passage in which a compressor, a first solenoid valve, a four-way valve, an outdoor heat exchanger, a pressure reducing device, an indoor heat exchanger, and an accumulator are sequentially connected through pipes; a second refrigerant passage in which a second solenoid valve and a water refrigerant heat exchanger are sequentially connected to a pipe that connects a portion of a pipe between the compressor and the first solenoid valve to the pressure reducing device; heating means for heating a shell of the compressor; and a controller that performs control so as to close the first solenoid valve and the second solenoid valve in association with an operation of the compressor being stopped and so as to open the first solenoid valve when the heating means heats the compressor.

Advantageous Effects of Invention

The refrigeration cycle device according to the present invention includes a first refrigerant passage in which a compressor, a first solenoid valve, a four-way valve, an outdoor heat exchanger, a pressure reducing device, an indoor heat exchanger, and an accumulator are sequentially connected through pipes; a second refrigerant passage in which a second solenoid valve and a water refrigerant heat exchanger are sequentially connected to a pipe that connects a portion of a pipe between the compressor and the first solenoid valve to the pressure reducing device; heating means for heating a shell of the compressor; and a controller that performs control so as to close the first solenoid valve and the second solenoid valve in association with an operation of the compressor being stopped and so as to open the first solenoid valve when the heating means heats the compressor. Therefore, the refrigeration cycle device has an advantage in that retention of refrigerant in a compressor can be prevented while the compressor is stopped by using a first solenoid valve and a second solenoid valve, which are provided for switching the refrigeration cycle device between a plurality of operation modes.

DESCRIPTION OF EMBODIMENTS

Embodiment 1

Figure 1:
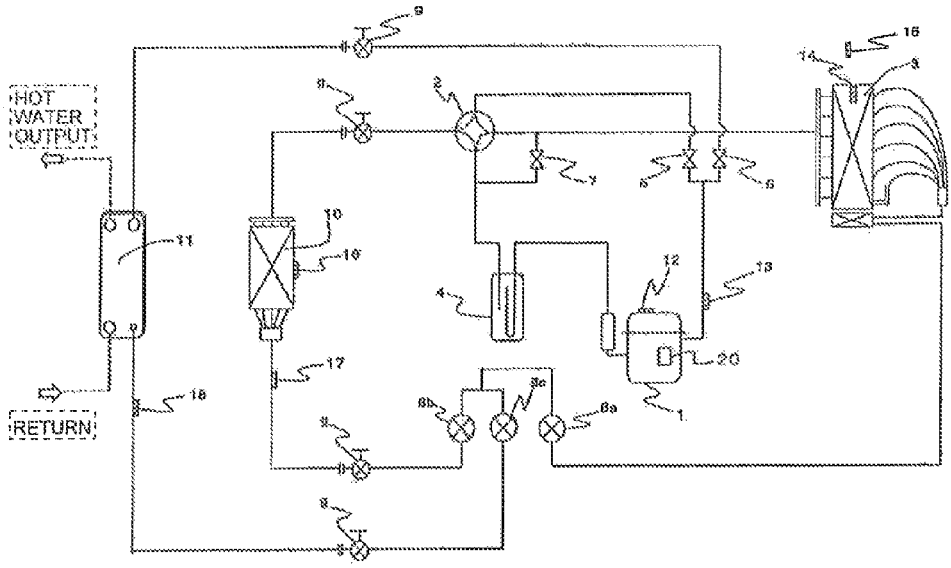
FIG. 1 is a refrigerant circuit diagram of a refrigeration cycle device according to Embodiment 1 of the present invention.
Figure 2:
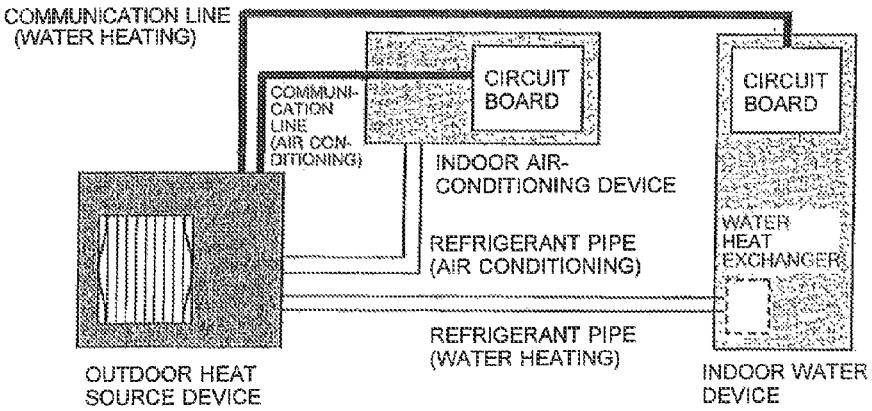
FIG. 2 is a schematic block diagram of the refrigeration cycle device according to Embodiment 1 of the present invention.

FIG. 1 is a refrigerant circuit diagram of a refrigeration cycle device according to Embodiment 1 of the present invention, and FIG. 2 is a schematic block diagram of the refrigeration cycle device. The refrigeration cycle device includes a first refrigerant passage having an annular shape and a second refrigerant passage. In the first refrigerant passage, a compressor 1, a first solenoid valve 5, a four-way valve 2, an outdoor heat exchanger 3, a first LEV (pressure reducing device) 8*a*, a second LEV (pressure reducing device) 8*b*, an indoor heat exchanger 10, and an accumulator 4 are sequentially connected through pipes. In the second refrigerant passage, a portion of a pipe between the first LEV (pressure reducing device) 8*a* and the second LEV (pressure reducing device) 8*b* is connected to a portion of a pipe between the compressor 1 and the first solenoid valve 5 through pipes; and a third LEV (pressure reducing device) 8*c*, a water refrigerant heat exchanger 11, and a second solenoid valve 6 are sequentially connected through pipes.

The refrigerant circuit further includes a bypass pipe. The bypass pipe connects a pipe that connects the first solenoid valve 5 to the outdoor heat exchanger 3 through the four-way valve 2 to a pipe that connects the indoor heat exchanger 10 to the compressor 1 through the four-way valve 2 and the accumulator 4. A third solenoid valve 7 is disposed in the bypass pipe. The first refrigerant passage and the second refrigerant passage constitute the refrigerant circuit of the refrigeration cycle device, through which refrigerant is circulated. The water refrigerant heat exchanger 11 of the refrigeration cycle device is a part of a water circuit to which a water pump (not shown) and a hot water tank are sequentially connected through pipes and through which water, which is a heat exchange medium, is circulated.

As illustrated in FIGS. 1 and 2, the refrigeration cycle device includes three separate devices, which are an outdoor heat source device, an indoor air-conditioning device, and an indoor water device. The outdoor heat source device includes the compressor 1, the first solenoid valve 5, the second solenoid valve 6, the four-way valve 2, the outdoor heat exchanger 3, first to third LEVs (pressure reducing devices) 8*a* to 8*c*, and an air-sending device (not shown). The indoor air-conditioning device includes the indoor heat exchanger 10 and an air-sending device (not shown). The indoor water device includes the water refrigerant heat exchanger 11, a water pump (not shown), and a hot water tank. These three devices are connected to one another through refrigerant pipes with the outdoor heat source device disposed in the middle thereof. Stop valves are disposed in connection pipes of the outdoor heat source device. The stop valves block flow of refrigerant out of the outdoor heat source device when, for example, an operation of connecting refrigerant pipes to the outdoor heat source device is performed.

The compressor 1 of the outdoor heat source device is a compressor whose capacity can be controlled by inverter drive control. The four-way valve 2, for switching between passages, switches between passages through which the indoor heat exchanger 10 is connected to the accumulator 4 and the first solenoid valve 5 is connected to the outdoor heat exchanger 3 and passages through which the indoor heat exchanger 10 is connected to the first solenoid valve 5 and the accumulator 4 is connected to the outdoor heat exchanger 3. Thus, the four-way valve 2 controls the direction in which the refrigerant flows.

The outdoor heat exchanger 3 is a fin-and-tube heat exchanger that exchanges heat between refrigerant and outdoor air that flows over a surface of the heat exchanger by being moved by an air-sending device disposed in the vicinity thereof. The accumulator 4 stores residual refrigerant in a liquid state and makes gas refrigerant to flow toward a suction side of the compressor. The first LEV 8*a*, the second LEV 8*b*, and the third LEV 8*c* adjust the pressure of refrigerant and control the direction in which the refrigerant flows by entirely closing the passages thereof.

The outdoor heat source device includes a compressor shell temperature sensor 12 (TH32) that detects the temperature of a surface of the compressor 1, a discharge pipe temperature sensor 13 (TH4) that is disposed in a discharge pipe of the compressor and that detects the temperature of discharged refrigerant, an outdoor-heat-exchanger temperature sensor 14 (TH6) that is disposed in the outdoor heat exchanger 3 and that detects the temperature of refrigerant in the heat exchanger, and an outdoor air temperature sensor 15 (TH7) that is disposed adjacent to a suction inlet for sucking outdoor air therethrough and that detects the temperature of outdoor air sucked into the heat exchanger.

The indoor heat exchanger 10 of the indoor air-conditioning device is a fin-and-tube heat exchanger that exchanges heat between refrigerant and indoor air that is sucked into the heat exchanger by an air-sending device disposed in the vicinity thereof. The indoor heat exchanger further includes an indoor-heat-exchanger temperature sensor 16 (TH5) that is disposed in the indoor heat exchanger and that detects the temperature of refrigerant in the heat exchanger, and an indoor-unit-liquid-pipe temperature sensor 17 (TH2a) that is disposed in a liquid-side pipe of the indoor heat exchanger 10 and that detects the temperature of liquid refrigerant.

The water refrigerant heat exchanger 11 of the indoor water device is a plate-type water heat exchanger that exchanges heat between refrigerant flowing through the second refrigerant passage and water flowing through the water circuit and thereby heats the water. The flow rate of water supplied to the water refrigerant heat exchanger 11 is controlled using a water pump disposed in the water circuit. Heated water flows in the hot water tank without being mixed with water in the hot water tank, is used as intermediary water that exchanges heat with water in the hot water tank, and thereby becomes cold water. Subsequently, the water flows out of the hot water tank, is supplied again, and becomes hot water in the water refrigerant heat exchanger 11.

The indoor water device includes temperature sensors, which are a water-refrigerant-heat-exchanger-liquid-pipe temperature sensor 18 (TH2b), an inlet water temperature sensor (not shown), and an outlet water temperature sensor (not shown). The water-refrigerant-heat-exchanger-liquid-pipe temperature sensor 18 is disposed on the liquid side of the water refrigerant heat exchanger 11, which is the outlet side of a refrigerant pipe of the water refrigerant heat exchanger 11, and detects the temperature of liquid refrigerant. The inlet water temperature sensor detects the temperature (inlet water temperature) of water that flows into the water circuit side of the water refrigerant heat exchanger 11. The outlet water temperature sensor detects the temperature (outlet water temperature) of water that flows out of the water refrigerant heat exchanger.

Examples of refrigerant used in the refrigeration cycle device include HFC refrigerants such as R410A, R407C, and R32 and natural refrigerants such as hydrocarbon and helium.

As illustrated in FIG. 2, which is a schematic block diagram of the refrigeration cycle device, the outdoor heat source device, which is disposed outdoors, is connected to the indoor air-conditioning device, which is disposed indoors, through a refrigerant pipe, and is connected the indoor water device, which is disposed indoor, through a refrigerant pipe. A controller (not shown) is disposed in the outdoor heat source device. The controller of the outdoor heat source device is connected to a control circuit board that is disposed in the indoor air-conditioning device through a communication line and is connected to a control circuit board that is disposed in the indoor water device through a communication line. The control circuit board of the indoor air-conditioning device determines the state of air-conditioning load in the indoor air-conditioning device from the temperature of indoor air detected by a sucked-air temperature sensor disposed in the indoor air-conditioning device and a set temperature set by a user. The control circuit board transmits and receives the result to the controller of the outdoor heat source device as a signal requesting driving of the compressor of the outdoor heat source device. The control circuit board of the water indoor unit determines whether or not supply of hot water is required in the water indoor unit, and transmits and receives the result to the controller of the outdoor heat source device as a signal requiring driving of the compressor of the outdoor heat source device.

Figure 3:
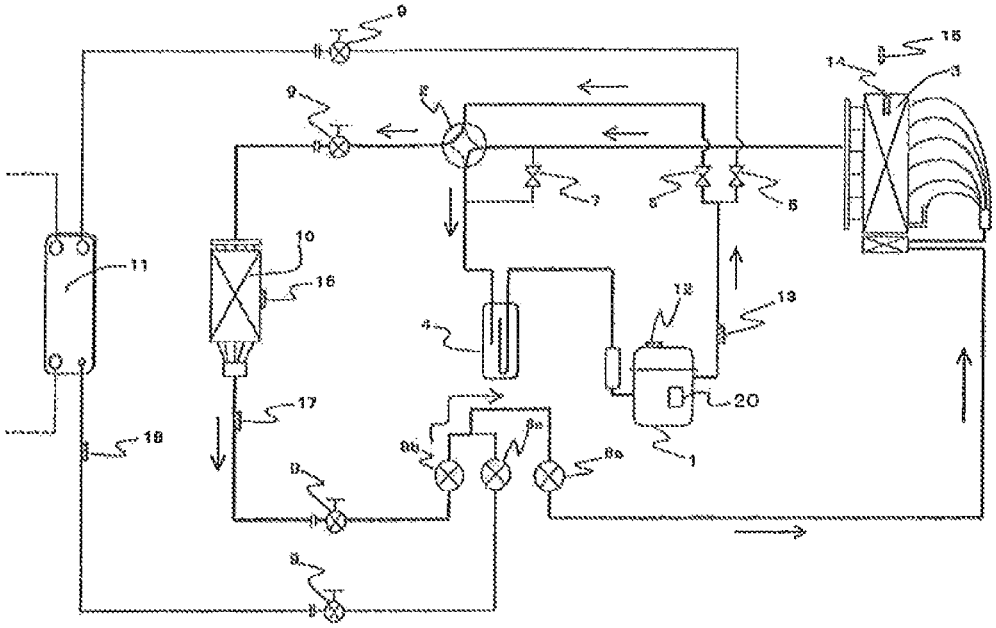
FIG. 3 is a refrigerant circuit diagram of the refrigeration cycle device according to Embodiment 1 of the present invention when an air-heating operation is performed.

Next, an air-heating operation performed by the refrigeration cycle device will be described. FIG. 3 illustrates flow of refrigerant during the air-heating operation and a control method used in the operation.

In the air-heating operation, the four-way valve 2 is set so that refrigerant discharged from the compressor 1 flows through the first solenoid valve 5 to the indoor heat exchanger 10 and refrigerant flowed out of the outdoor heat exchanger 3 flows to the accumulator 4. The first solenoid valve 5 is opened, the second solenoid valve 6 and the third solenoid valve 7 are closed, and the third LEV (pressure reducing device) 8*c* is entirely closed.

High-temperature high-pressure gas refrigerant is discharged from the compressor 1, flows out of the outdoor heat source device through the first solenoid valve 5 and the four-way valve 2, and then flows into the indoor heat exchanger 10 of the indoor air-conditioning device through a connection pipe. In the indoor heat exchanger 10, the high-temperature high-pressure gas refrigerant heats indoor air supplied by the air-sending device, thereby becomes high-pressure liquid refrigerant, and flows out of the heat exchanger. The high-pressure liquid refrigerant flows into the outdoor heat source device through a connection pipe, passes through the second LEV 8*b*, which has been controlled to be entirely open, is depressurized by the first LEV 8*a*, and becomes low-pressure two phase refrigerant. The low-pressure two phase refrigerant flows into the outdoor heat exchanger 3, exchanges heat with outdoor air supplied by the air-sending device, and thereby becomes low-pressure gas refrigerant. The low-pressure gas refrigerant flows into the accumulator 4 through the four-way valve 2, is sucked into the compressor 1 again, and forms a refrigerant circuit of the air-heating operation.

Figure 4:
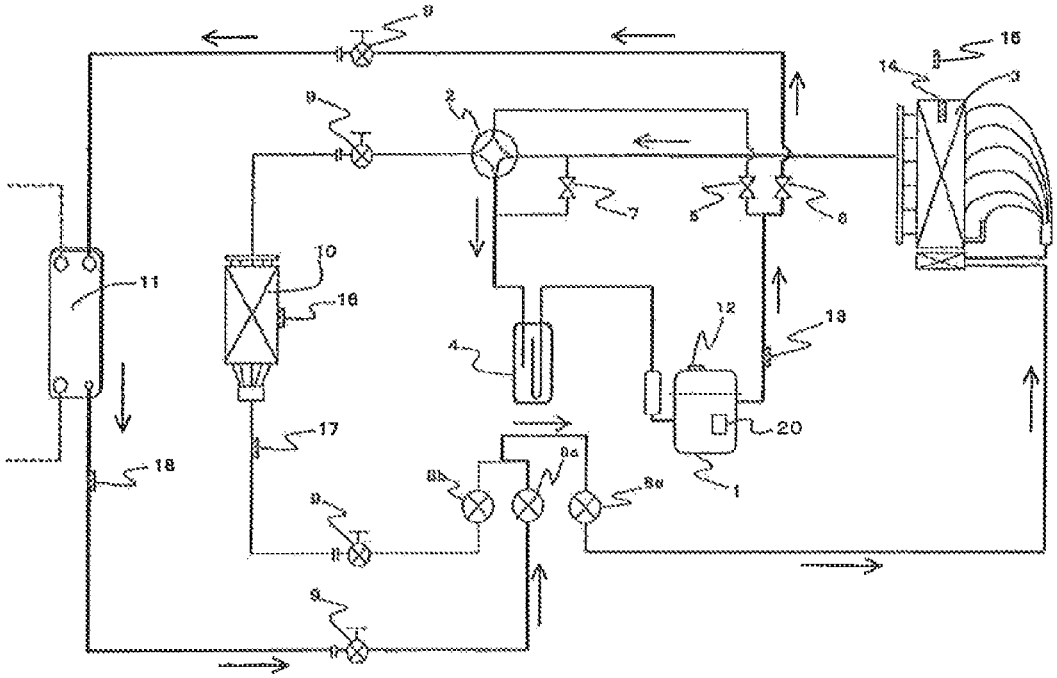
FIG. 4 is a refrigerant circuit diagram of the refrigeration cycle device according to Embodiment 1 of the present invention when a water-heating operation is performed.

Next, a water-heating operation performed by the refrigeration cycle device will be described. FIG. 4 illustrates flow of refrigerant during the water-heating operation and a control method used in the operation.

In the water-heating operation, the four-way valve 2 is set so that refrigerant discharged from the compressor 1 flows through the second solenoid valve 6 to the water refrigerant heat exchanger 11 and refrigerant flowed out of the outdoor heat exchanger 3 flows to the accumulator 4. The second solenoid valve 6 is opened, the first solenoid valve 5 and the third solenoid valve 7 are closed, and the second LEV (pressure reducing device) 8*b* is entirely closed.

High-temperature high-pressure gas refrigerant is discharged from the compressor 1, flows out of the outdoor heat source device through the second solenoid valve 6, and then flows into the water refrigerant heat exchanger 11 of the indoor water device through a connection pipe. In the water refrigerant heat exchanger 11, the high-temperature high-pressure gas refrigerant heats water supplied by the water pump, thereby becomes high-pressure liquid refrigerant, and flows out of the water refrigerant heat exchanger 11. The high-pressure liquid refrigerant flows into the outdoor heat source device through a connection pipe, passes through the third LEV 8*c*, which has been controlled to be entirely open, is depressurized by the first LEV 8*a*, and becomes low-pressure two phase refrigerant. The low-pressure two phase refrigerant flows into the outdoor heat exchanger 3, exchanges heat with outdoor air supplied by the air-sending device, and thereby becomes low-pressure gas refrigerant. The low-pressure gas refrigerant flows into the accumulator 4 through the four-way valve 2, is sucked into the compressor 1 again, and forms a refrigerant circuit of the water-heating operation.

Figure 5:
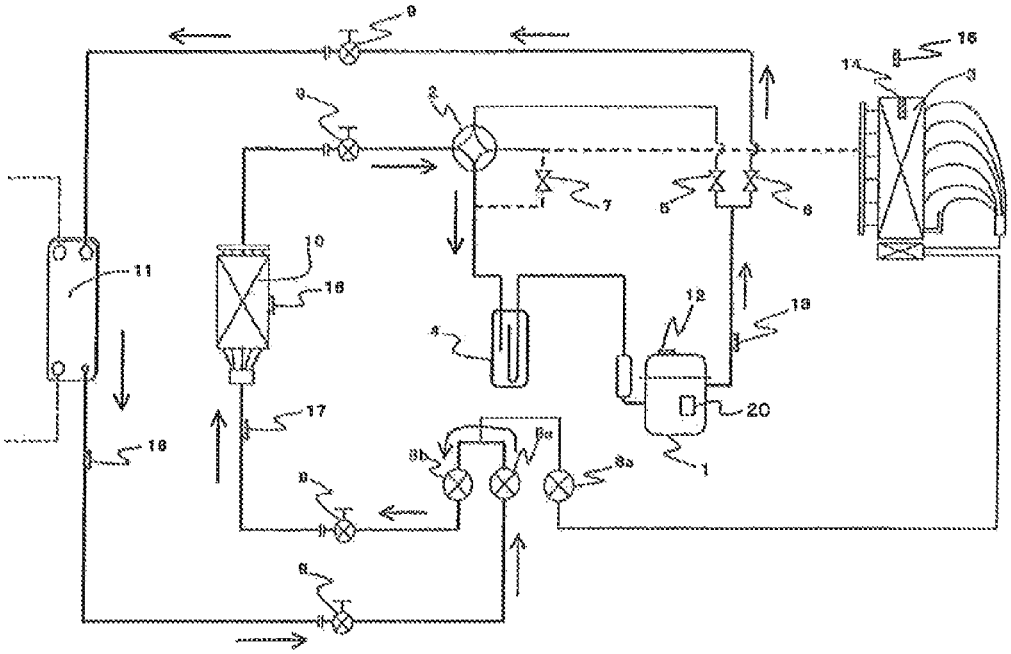
FIG. 5 is a refrigerant circuit diagram of the refrigeration cycle device according to Embodiment 1 of the present invention when a simultaneous air-cooling and water-heating operation is performed.

Next, a simultaneous air-cooling and water-heating operation performed by the refrigeration cycle device will be described. FIG. 5 illustrates flow of refrigerant during the simultaneous air-cooling and water-heating operation and a control method used in the operation.

In the simultaneous air-cooling and water-heating operation, the four-way valve 2 is set so that a refrigerant pipe from the first solenoid valve 5 is connected to a pipe from the outdoor heat exchanger 3 and so that refrigerant flowed out of the indoor heat exchanger 10 flows to the accumulator 4. The first solenoid valve 5 is closed, the second solenoid valve 6 and the third solenoid valve 7 are opened, and the first LEV (pressure reducing device) 8*a* is entirely closed.

High-temperature high-pressure gas refrigerant is discharged from the compressor 1, flows out of the outdoor heat source device through the second solenoid valve 6, and then flows into the water refrigerant heat exchanger 11 of the indoor water device through a connection pipe. In the water refrigerant heat exchanger 11, the high-temperature high-pressure gas refrigerant heats water supplied by the water pump, becomes high-pressure liquid refrigerant, and flows out of the water refrigerant heat exchanger 11. Subsequently, the high-pressure liquid refrigerant flows into the outdoor heat source device through a connection pipe, passes through the third LEV 8*c*, which has been controlled to be entirely open, because the first LEV 8*a* has been controlled to be entirely closed, is depressurized by the second LEV 8*b*, and thereby becomes low-pressure two phase refrigerant. The low-pressure two phase refrigerant flows into the indoor heat exchanger 10, exchanges heat with indoor air supplied by the air-sending device, and thereby becomes low-pressure gas refrigerant. The low-pressure gas refrigerant flows into the accumulator 4 through the four-way valve 2, is sucked into the compressor 1 again, and forms a refrigerant circuit of the simultaneous air-cooling and water-heating operation.

In the simultaneous air-cooling and water-heating operation, the valve opening degree of the first LEV (pressure reducing device) 8*a* is controlled to be entirely closed, and therefore the refrigerant circuit is set so that the mainstream of refrigerant does not flow into the outdoor heat exchanger 3. Accordingly, the amount of heat exchanged in the outdoor heat exchanger 3 is zero, and an exhaust heat recovery operation, in which exhaust heat from the indoor air-conditioning device is recovered by the indoor water device, is performed. The first solenoid valve 5 is closed and the third solenoid valve 7 is opened, and thereby the four-way valve side of the outdoor heat exchanger 3 is connected to the suction side of the compressor. Thus, the pressure in the outdoor heat exchanger 3 is reduced, and thereby accumulation of refrigerant in the outdoor heat exchanger 3 can be prevented.

In the refrigeration cycle device having the structure described above, not only the refrigerant but also refrigerating machine oil that is used to lubricate the drive unit is present. The refrigerating machine oil is not always contained in the compressor, and a small amount of the refrigerating machine oil is constantly taken out of the compressor during an operation of the refrigeration cycle device and circulates in the refrigerant circuit together with the refrigerant. If a large amount of the refrigerating machine oil is discharged from the inside of the compressor and the amount of the refrigerating machine oil remaining in the compressor drive unit becomes insufficient, seizure of the drive shaft of the compressor may occur and the compressor may malfunction. Moreover, the refrigerating machine oil may become mixed and diluted with the refrigerant. If the viscosity of the refrigerating machine oil is reduced by dilution with the refrigerant, the amount of the refrigerating machine oil in the compressor becomes insufficient. As a result, also in this case, seizure of the drive shaft of the compressor may occur and the compressor may malfunction.

In general, such insufficiency in the amount of the refrigerating machine oil occurs mainly due to accumulation of refrigerant in the compressor. As the temperature of the compressor decreases after the refrigeration cycle device has been stopped, refrigerant flows into the compressor from refrigerant circuits connected to the compressor and the amount of refrigerant in the compressor increases. Then, the refrigerant dissolves into the refrigerating machine oil (referred to as retention of refrigerant in refrigerating machine oil), and thereby dilution of the refrigerating machine oil with refrigerant may occur or increase in the amount of refrigerating machine oil taken out of the compressor when starting an operation may occur.

A probable cause of accumulation of refrigerant in the compressor is a low temperature of the compressor. After an operation of the refrigeration cycle device has been stopped, the difference in pressure occurring in the refrigerant circuit gradually decreases and the pressure in the refrigerant circuit gradually becomes uniform. At this time, the refrigerant flows to a portion at which temperature and the pressure are relatively low. Therefore, when the temperature and the pressure in the compressor become lower than those in the surrounding portions, the refrigerant gradually accumulates in the compressor to the extent that may cause malfunctioning of the compressor as described above.

To solve this problem, it is necessary to perform a compressor heating operation in which the compressor is heated to prevent accumulation of refrigerant in the compressor. Examples of a method (or a heat source) for heating the compressor include a method of attaching a heater to the outside of a shell of the compressor and generating heat by energizing the heater and a method of energizing a motor in the compressor and heating the compressor with heat generated by the motor. For example, while the compressor is stopped, the compressor may be heated without rotating the motor of the compressor by Joule heat generated by applying a high-frequency low voltage to a coil of the motor, or the compressor may be heated by Joule heat generated by energizing the motor of the compressor in an open-phase state and thereby making the electric current to flow through the coil without rotating the motor. Such an operation, in which an electric current is applied to a coil of a motor without rotating the motor and thereby heating the compressor by heat generated by the motor, will be referred to as a constraint energization heating operation. A control operation of performing the constraint energization heating operation and the aforementioned operation of performing heating by energizing a heater will be collectively referred to as a compressor heating operation.

With the refrigeration cycle device according to Embodiment 1 of the present invention, an inverter control circuit of the controller of the outdoor heat source device supplies an electric current that is applied to a coil of a motor for rotating a compression mechanism of the compressor 1. By controlling application of the electric current as described above, a constraint energization heating operation can be performed on the compressor.

After an ordinarily and necessary operation of the refrigeration cycle device has been finished, to prevent refrigerant distributed in the pipes and the heat exchangers of the refrigerant circuit from flowing into the compressor while the compressor is stopped, the first solenoid valve 5 and the second solenoid valve 6 disposed in the discharge-side pipes of the compressor 1 are controlled to be closed in association with the compressor being stopped. By closing the solenoid valves, refrigerant discharged from the compressor can be prevented from flowing back to the compressor. Then, to prevent retention of refrigerant in refrigerating machine oil in the compressor, a constraint energization heating operation, which is an example of a compressor heating operation for heating the compressor 1, is performed. At this time, control is performed so as to open the first solenoid valve 5, which is one of the solenoid valves disposed in the compressor discharge pipe, and so as to keep closing the second solenoid valve 6, which is the other of the solenoid valves. Thus, refrigerant that has been heated and vaporized in the compressor passes through the discharge pipe of the compressor 1 and the first solenoid valve 5 and flows to heat exchangers and the like of the refrigerant circuit, and thereby retention of refrigerant in the refrigerating machine oil in the compressor can be prevented.

The conditions for performing a compressor heating operation to prevent retention of refrigerant in the compressor is determined by using a compressor shell temperature Ta detected by the compressor shell temperature sensor 12 (TH32), and an outdoor air temperature Tb detected by the outdoor air temperature sensor 15 (TH7) or an outdoor heat exchanger temperature Tc detected by the outdoor-heat-exchanger temperature sensor 14 (TH6). The controller of the outdoor heat source device performs calculation to compare the compressor shell temperature Ta with the outdoor air temperature Tb. The controller performs control so as to start a compressor heating operation if the compressor shell temperature Ta becomes lower than the outdoor air temperature Tb by a predetermined temperature $\alpha$ or more while the controller performs control so as to stop the compressor heating operation if the compressor shell temperature Ta becomes higher than the outdoor air temperature Tb by the predetermined temperature α or more during the compressor heating operation. Thus, a compressor heating operation can be appropriately performed to prevent retention of refrigerant, and an energy saving effect can be obtained by reducing power loss due to an excessive heating operation.

Here, the predetermined temperature α will be described. When determining whether or not to perform a compressor heating operation by using the compressor shell temperature Ta and the outdoor air temperature Tb, if the compressor shell temperature is approximately equal to the outdoor air temperature, hunting of energization for heating, that is, oscillation between energization and de-energization in a short time may occur. To avoid hunting, hysteresis is provided to the conditions for controlling temperature by using the predetermined temperature α, which is a constant.

When the constraint energization heating operation for heating the compressor is performed at a predetermined time and it is determined that retention of the refrigerant is resolved, the compressor heating operation is finished. At the time when the compressor heating operation is finished, the first solenoid valve 5 is open. However, if the compressor shell temperature Ta detected by the compressor shell temperature sensor 12 (TH32) becomes lower than the outdoor air temperature Tb detected by the outdoor air temperature sensor 15 (TH7), control is performed so as to close the first solenoid valve 5 and maintain the closed state.

In general, it is necessary to suppress retention of the refrigerant in the refrigerating machine oil in the compressor under the conditions such that the outdoor air temperature is low and there is a difference between the outdoor air temperature and the temperature of the inside of the compressor. Such conditions correspond to the conditions under which an air-heating operation or a water-heating operation is performed. When the refrigerant circuit has been set in these operation modes, the four-way valve is set so as to connect a pipe from the first solenoid valve to a pipe from the indoor heat exchanger and so as to connect the outdoor heat exchanger to the accumulator.

If it is necessary for the refrigeration cycle device to prevent retention of the refrigerant during a simultaneous air-cooling and water-heating operation, as in the case described above, a compressor heating operation is performed while the compressor is stopped. The refrigerant circuit is set such that the four-way valve connects a pipe from the first solenoid valve to a pipe from the outdoor heat exchanger and so as to connect the indoor heat exchanger to the accumulator. During a compressor heating operation, the first solenoid valve is controlled to be open, and thereby refrigerant that has been heated and vaporized in the compressor can be rapidly discharged to portions of the refrigerant circuit outside of the compressor.

As described above, the refrigeration cycle device according to the present invention includes the first solenoid valve 5 and the second solenoid valve 6, which are disposed in pipes on the discharge side of the compressor and which are used to switch between an air-heating operation, a water-heating operation, and a simultaneous air-cooling and water-heating operation; and the solenoid valves are closed in association with the compressor being stopped. Therefore, refrigerant is prevented from flowing back to the compressor from the refrigerant circuit and prevented from retained in the compressor. If it is determined that retention of refrigerant in the compressor is occurring, a compressor heating operation is performed and the first solenoid valve is opened to discharge the refrigerant that has been heated and vaporized from the refrigerant circuit through the first solenoid valve. As a result, retention of refrigerant in the compressor can be prevented, and therefore the refrigerant cycle device has an advantage of preventing malfunctioning of the compressor due to seizure of the drive shaft.

A compressor heating operation is controlled by using the compressor shell temperature detected by the compressor shell temperature sensor and the outdoor air temperature detected by the outdoor air temperature sensor. Therefore, the compressor heating operation can be appropriately performed to prevent retention of refrigerant, and an energy saving effect can be obtained by reducing power consumption loss due to an excessive and unnecessary heating operation.

REFERENCE SIGNS LIST

1: compressor, 2: four-way valve, 3: outdoor heat exchanger, 4: accumulator, 5: first solenoid valve, 6: second solenoid valve, 7: third solenoid valve, 8*a*: first LEV, 8*b*: second LEV, 8*c*: third LEV, 9: stop valve, 10: indoor heat exchanger, 11: water refrigerant heat exchanger, 12: compressor shell temperature sensor, 13: discharge pipe temperature sensor, 14: outdoor-heat-exchanger, temperature sensor, 15: outdoor air temperature sensor, 16: indoor-heat-exchanger, temperature sensor, 17: indoor-unit-liquid-pipe temperature sensor, 18: water-refrigerant-heat-exchanger-liquid-pipe temperature sensor, 20: heat source (or heating means)

The invention claimed is:

1. A refrigeration cycle device comprising:

a first refrigerant passage in which a compressor, a first solenoid valve, a four-way valve, an outdoor heat exchanger, a pressure reducing device, an indoor heat exchanger, and an accumulator are sequentially connected through pipes;

a second refrigerant passage in which a second solenoid valve and a water refrigerant heat exchanger are sequentially connected, the second refrigerant passage connecting a portion of a pipe between the compressor and the first solenoid valve to the pressure reducing device;

a heat source for heating a shell of the compressor; and a controller that performs control so as to close the first solenoid valve and the second solenoid valve in association with an operation of the compressor being stopped and so as to open the first solenoid valve when the heat source heats the compressor.

2. The refrigeration cycle device of claim 1 further comprising:

a compressor shell temperature sensor that detects a compressor shell temperature, which is a temperature of a surface of the shell of the compressor; and an outdoor air temperature sensor that detects an outdoor air temperature, which is a temperature of outdoor air that passes through the outdoor heat exchanger, wherein, after the heat source has finished a compressor heating operation, the first solenoid valve is closed if the compressor shell temperature detected by the compressor shell temperature sensor becomes lower than the outdoor air temperature detected by the outdoor air temperature sensor.

3. The refrigeration cycle device of claim 2, wherein, when the heat source performs a compressor heating operation, the four-way valve is set so as to connect the first solenoid valve to the indoor heat exchanger and connect the accumulator to the outdoor heat exchanger.

4. The refrigeration cycle device of claim 2 further comprising a bypass pipe in which a third solenoid valve is disposed, the bypass pipe being disposed between a pipe connecting the four-way valve to the outdoor heat exchanger and a pipe connecting the four-way valve to the accumulator, wherein, when the heat source performs a compressor heating operation, in a case where the four-way valve is set so as to connect the first solenoid valve to the outdoor heat exchanger and connect the accumulator to the indoor heat exchanger, the third solenoid valve is opened.

5. The refrigeration cycle device of claim 1, wherein, when the heat source performs a compressor heating operation, the four-way valve is set so as to connect the first solenoid valve to the indoor heat exchanger and connect the accumulator to the outdoor heat exchanger.

6. The refrigeration cycle device of claim 1 further comprising a bypass pipe in which a third solenoid valve is disposed, the bypass pipe being disposed between a pipe connecting the four-way valve to the outdoor heat exchanger and a pipe connecting the four-way valve to the accumulator, wherein, when the heat source performs a compressor heating operation, in a case where the four-way valve is set so as to connect the first solenoid valve to the outdoor heat exchanger and connect the accumulator to the indoor heat exchanger, the third solenoid valve is opened.

7. The refrigeration cycle device of claim 1 further comprising a compressor shell temperature sensor that detects a compressor shell temperature, which is a temperature of a surface of the shell of the compressor; and an outdoor air temperature sensor that detects an outdoor air temperature, which is a temperature of outdoor air that passes through the outdoor heat exchanger, wherein the compressor shell temperature detected by the compressor shell temperature sensor and the outdoor air temperature detected by the outdoor air temperature sensor are compared with each other, and the heat source starts a compressor heating operation if the compressor shell temperature becomes lower than the outdoor air temperature by a predetermined temperature or more and finishes the compressor heating operation if the compressor shell temperature becomes higher than the outdoor air temperature by the predetermined temperature or more.

8. The refrigeration cycle in claim 1, wherein the indoor air-conditioning device further comprises a first control circuit board, the first control circuit board configured to determine a load of the indoor air-conditioning device and to transmit the load information to the controller, the indoor water device further comprises a second control circuit board, the second control circuit board configured to determine whether the indoor water device contains water and to transmit the determination to the controller, and the heat source is connected to the first control circuit board and the second control circuit board via at least one communication line.

9. The refrigeration cycle in claim 1, wherein the compressor, the first solenoid valve, the four-way valve, the outdoor heat exchanger, the pressure reducing device, the indoor heat exchanger, and the accumulator are sequentially connected in this order, and the second solenoid valve and the water refrigerant heat exchanger are sequentially connected in this order.

10. The refrigeration cycle in claim 1, wherein the controller is configured to close the first solenoid valve and the second solenoid valve when the compressor is stopped and to open the first solenoid valve after the heat source heats the compressor.

* * * * *